US010128607B2

(12) United States Patent
Lane et al.

(10) Patent No.: US 10,128,607 B2
(45) Date of Patent: Nov. 13, 2018

(54) SEALED CONNECTOR SYSTEM

(71) Applicant: TE CONNECTIVITY CORPORATION, Berwyn, PA (US)

(72) Inventors: David James Lane, Hummelstown, PA (US); Douglas John Hardy, Middletown, PA (US); John Wesley Hall, Harrisburg, PA (US); Neil Franklin Schroll, Mount Joy, PA (US); James Michael Raudenbush, Halifax, PA (US); Paul Steven Sremcich, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/440,654

(22) Filed: Feb. 23, 2017

(65) Prior Publication Data

US 2018/0241151 A1 Aug. 23, 2018

(51) Int. Cl.
*H01R 13/52* (2006.01)
*H01R 13/627* (2006.01)

(52) U.S. Cl.
CPC ..... *H01R 13/5219* (2013.01); *H01R 13/6272* (2013.01)

(58) Field of Classification Search
CPC ..... H01R 13/514; H01R 33/95
USPC ..... 439/701, 587, 281, 282, 358
See application file for complete search history.

(56) References Cited

U.S. PATENT DOCUMENTS 3,937,545 A * 2/1976 Cairns ..... H01R 13/5221 439/272
4,639,061 A * 1/1987 Muzslay ..... H01R 13/5221 439/281
4,963,103 A * 10/1990 Fink ..... H01R 13/6272 439/352
4,973,266 A * 11/1990 Bullard ..... H01R 13/5221 439/281
4,973,268 A * 11/1990 Smith ..... H01R 13/4365 439/589
5,484,301 A 1/1996 Koumatsu et al.
(Continued)

FOREIGN PATENT DOCUMENTS

CN 101330175 A 12/2008

OTHER PUBLICATIONS

International Search Report, International Application No. PCT/IB2018/050928, International Filing Date Feb. 15, 2018.

*Primary Examiner* — Tho D Ta
*Assistant Examiner* — Marcus Harcum

(57) ABSTRACT

A receptacle connector includes an outer housing, an inner housing, and an interface seal. The outer housing defines a cavity configured to receive a plug connector through a mating opening of the outer housing. The inner housing is disposed within the cavity of the outer housing. The inner housing holds a contact subassembly that is connected to a cable. The inner housing includes a sleeve that surrounds a mating section of the contact subassembly. The sleeve is spaced apart from an interior surface of the outer housing by an annular gap. The interface seal is on an outer surface of the sleeve. The interface seal engages an inner surface of a nose of the plug connector within the annular gap to seal an interface between the sleeve of the inner housing and the nose of the plug connector.

18 Claims, 5 Drawing Sheets

(56) References Cited

U.S. PATENT DOCUMENTS

| | | | | |
|---|---|---|---|---|
| 7,044,762 | B1 * | 5/2006 | Hong | H01R 13/5213 439/275 |
| 7,114,983 | B2 * | 10/2006 | Fukatsu | H01R 13/4223 439/358 |
| 7,214,080 | B2 * | 5/2007 | Ichio | H01R 13/6272 439/246 |
| 8,628,252 | B2 * | 1/2014 | Matsumoto | G02B 6/3879 385/56 |
| 2001/0041470 | A1 | 11/2001 | Makita | |
| 2004/0005805 | A1 * | 1/2004 | Shibata | H01R 13/5219 439/358 |
| 2004/0198100 | A1 * | 10/2004 | Fink | H01R 13/512 439/701 |
| 2007/0054535 | A1 * | 3/2007 | Hall | H01R 13/6272 439/352 |
| 2009/0035976 | A1 | 2/2009 | Matsunaga | |
| 2009/0111312 | A1 * | 4/2009 | Nakata | H01R 13/6277 439/357 |
| 2013/0309904 | A1 * | 11/2013 | Hall | H01R 12/57 439/578 |

* cited by examiner

SEALED CONNECTOR SYSTEM

BACKGROUND OF THE INVENTION

The subject matter herein relates generally to connectors. Radio frequency (RF) connectors are used for numerous applications including military applications and automotive applications. For example, RF connectors may be used with global positioning systems (GPS), antennas, radios, mobile phones, multimedia devices, and the like. Some connectors are terminated to coaxial cables. In one or more of the identified applications, the connectors may be exposed to debris, contaminants, and environmental elements, such as dirt, oil, water, freezing temperatures, and the like. The debris, contaminants, and elements may interfere with signal transmission through the connectors and/or damage the electrical components of the connectors if allowed to penetrate and enter inner cavities of the electrical connectors.

It may be difficult to adequately seal some connectors due to the presence of multiple openings and interfaces along a housing of a corresponding connector, which are potential ingress locations for debris, contaminants, and elements into the internal cavity of the connector. In addition, some connectors have a small size with limited space available for installing seals or gaskets at various openings and interfaces. The small size of the connectors may be due to industry standards or trends. Thin seals molded to fit within narrow spaces on such connectors may risk tearing or rolling out of position during assembly or use, resulting in the formation of leak paths around the seal.

A need remains for a connector that provides reliable sealing from external debris, contaminants, and elements.

BRIEF DESCRIPTION OF THE INVENTION

In one embodiment, a receptacle connector is provided that includes an outer housing, an inner housing, and an interface seal. The outer housing defines a cavity through the outer housing between a front end and an opposite rear end of the outer housing. The outer housing is configured to receive a plug connector into the cavity through a mating opening at the front end. The inner housing is disposed within the cavity of the outer housing. The inner housing defines a channel through the inner housing between a mating end and an opposite cable end of the inner housing. The inner housing holds a contact subassembly within the channel. The contact subassembly is electrically and mechanically connected to a cable protruding from the cable end of the inner housing. The inner housing includes a sleeve extending to the mating end. The sleeve surrounds a mating section of the contact subassembly. The sleeve is spaced apart from an interior surface of the outer housing by an annular gap. The interface seal is on an outer surface of the sleeve of the inner housing. The interface seal is configured to engage an inner surface of a nose of the plug connector within the annular gap to seal an interface between the sleeve of the inner housing and the nose of the plug connector.

In another embodiment, a connector system is provided that includes a receptacle connector and a plug connector. The receptacle connector includes a housing assembly, a first contact subassembly, and an interface seal. The housing assembly defines a cavity that is open at a front end of the housing assembly. The housing assembly includes a sleeve disposed within the cavity. The sleeve surrounds a mating section of the first contact subassembly. The housing assembly defines an annular gap between an outer surface of the sleeve and an interior surface of the housing assembly that defines the cavity. The interface seal is bonded to the outer surface of the sleeve and extends circumferentially around the sleeve. The plug connector includes a housing and a second contact subassembly. The housing includes a nose at a mating end thereof that surrounds a mating section of the second contact subassembly. The plug connector is configured to be received within the cavity of the housing assembly such that the nose is received within the annular gap radially outside of the sleeve. The mating section of the second contact subassembly engages the mating section of the first contact subassembly within the sleeve. The interface seal engages an inner surface of the nose to seal an interface between the sleeve of the receptacle connector and the nose of the plug connector.

In another embodiment, a receptacle connector is provided that includes an outer housing, an inner housing, and an interface seal. The outer housing defines a cavity through the outer housing between a front end and an opposite rear end of the outer housing. The outer housing defines a mating opening to the cavity at the front end and a key slot extending radially outward from the mating opening. The mating opening is configured to receive a nose of a plug connector therethrough, and the key slot is configured to receive a key member therethrough. The key member extends outward from the nose of the plug connector to orient the plug connector relative to the housing. The inner housing is disposed within the cavity of the outer housing. The inner housing defines a channel through the inner housing between a mating end and an opposite cable end of the inner housing. The inner housing holds a contact subassembly within the channel. The contact subassembly is electrically and mechanically connected to a cable protruding from the cable end of the inner housing. The inner housing includes a sleeve extending to the mating end. The sleeve surrounds a mating section of the contact subassembly. The sleeve is spaced apart from an interior surface of the outer housing by an annular gap. The interface seal is on an outer surface of the sleeve of the inner housing. The interface seal is configured to engage an inner surface of a nose of the plug connector within the annular gap to seal an interface between the sleeve of the inner housing and the nose of the plug connector.

DETAILED DESCRIPTION OF THE INVENTION

Figure 1:
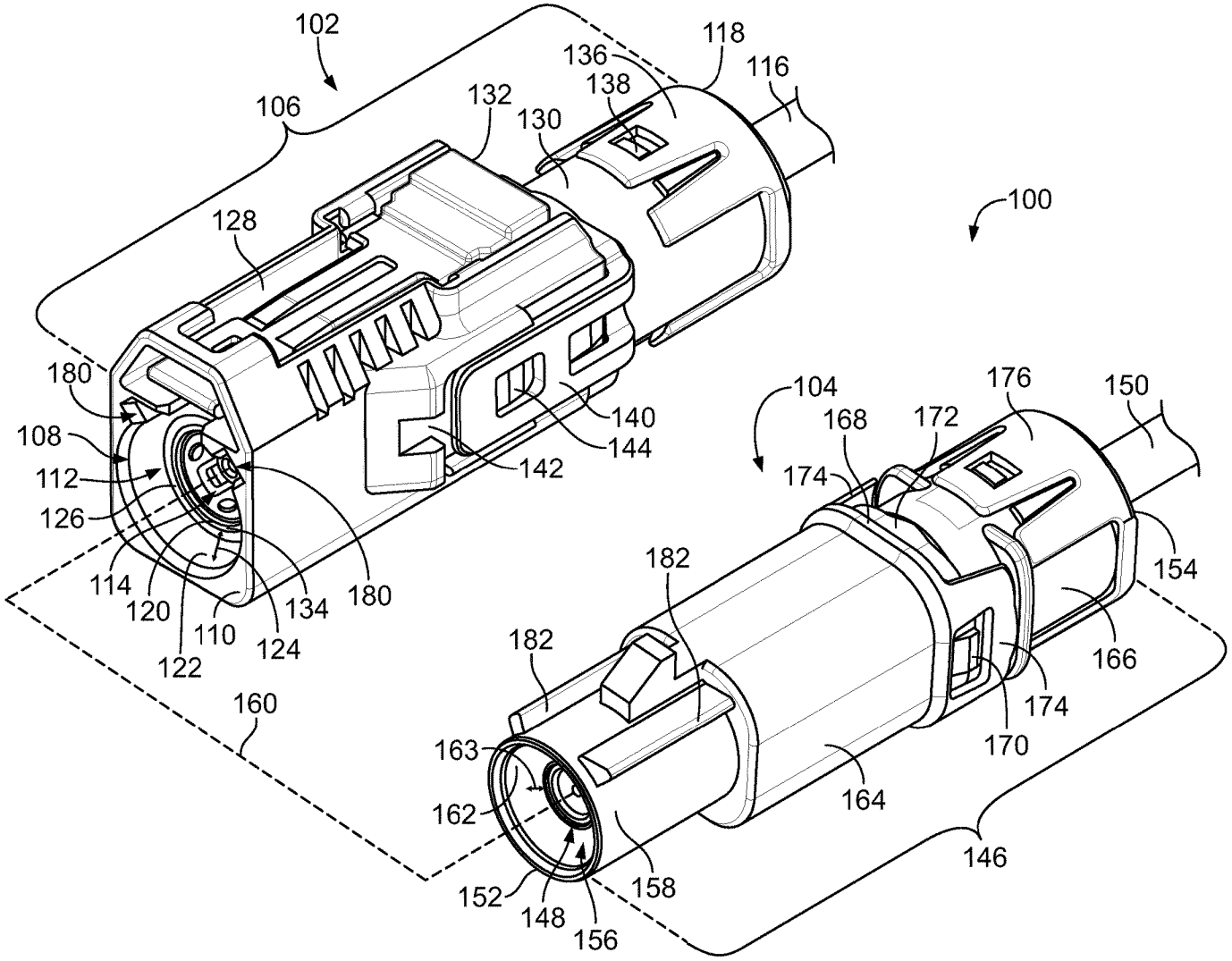
FIG. 1 illustrates a connector system formed in accordance with an exemplary embodiment.

FIG. 1 illustrates a connector system 100 formed in accordance with an exemplary embodiment. The connector system 100 includes a receptacle connector 102 and a plug connector 104. The receptacle connector 102 and the plug connector 104 are configured to be connected together to transmit electric current, such as power and/or signals, therebetween. For example, electrical conductors of the receptacle connector 102 engage corresponding electrical conductors of the plug connector 104 when the connectors 102, 104 are mated to provide a conductive signal path across the connectors 102, 104. The receptacle connector 102 is unmated from the plug connector 104 in the illustrated embodiment.

The receptacle connector 102 includes a housing assembly 106 that defines mating opening 108 at a front end 110 of the housing assembly 106. As used herein, relative or spatial terms such as "top," "bottom," "front," "rear," "left," and "right" are only used to distinguish the referenced elements and do not necessarily require particular positions or orientations in the connector system 100 or in the surrounding environment of the connector system 100. The mating opening 108 provides a passage into an internal cavity 112 within the housing assembly 106. The receptacle connector 102 includes a first contact subassembly 114 held within the cavity 112. The first contact subassembly 114 includes at least one electrical conductor and is electrically and mechanically terminated (e.g., connected) to an electrical cable 116. The cable 116 may be a coaxial cable, such as types 1.5D, RTK-031, or the like. The cable 116 protrudes from the cavity 112 beyond a cable end 118 of the housing assembly 106. In the illustrated embodiment, the receptacle connector 102 is an inline or 180 degree connector such that the front end 110 is oriented generally parallel to the cable end 118, and the cavity 112 extends generally linearly between the front end 110 and the cable end 118.

The housing assembly 106 includes a sleeve 120 disposed within the cavity 112 proximate to the front end 110. The sleeve 120 is hollow and surrounds a mating section of the first contact subassembly 114. As shown and described in more detail herein, the sleeve 120 is spaced apart radially from an interior surface 122 of the housing assembly 106 that defines a perimeter of the cavity. For example, an annular gap 124 is defined between the sleeve 120 and the interior surface 122. An interface seal 126 is disposed on the sleeve 120. The interface seal 126 circumferentially surrounds the sleeve 120 and is configured to engage the plug connector 104 to seal an interface between the two connectors 102, 104 when mated.

In the illustrated embodiment, the housing assembly 106 includes an outer housing 128 and an inner housing 130. The outer housing 128 extends from the front end 110 to a rear end 132 of the outer housing 128, and defines the cavity 112 therethrough between the front and rear ends 110, 132. The inner housing 130 extends from a mating end 134 to the cable end 118. The sleeve 120 extends to (and defines) the mating end 134. The inner housing 130 is held in the cavity 112. The inner housing 130 protrudes from the rear end 132 of the outer housing 128 such that the cable end 118 is rearward of the rear end 132. In an embodiment, the inner housing 130 includes a latch arm 140 that extends outward from the inner housing 130 at a location rearward of the rear end 132 of the outer housing 128. The latch arm 140 extends frontward around the rear end 132 generally parallel to and/or in engagement with an exterior surface 142 of the outer housing 128. The latch arm 140 couples to a locking tab 144 that protrudes from the exterior surface 142 to secure the inner housing 130 to the outer housing 128. The latch arm 140 can be pulled (or pushed) to deflect outward relative to the locking tab 144 to selectively uncouple the latch arm 140 from the locking tab 144 and allow disassembly of the housing assembly 106.

The receptacle connector 102 includes a wire seal cover 136 that covers the cable end 118 of the inner housing 130 and extends around the cable 116 to block that passage of debris and contaminants into the inner housing 130 through the cable end 118. In the illustrated embodiment, the wire seal cover 136 is secured to the inner housing 130 via catching on a cover locking tab 138 of the inner housing 130, but in other embodiments the wire seal cover 136 may be secured to the inner housing 130 by an interference fit.

The plug connector 104 includes a housing assembly 146 extending between a mating end 152 and an opposite cable end 154. The housing assembly 146 holds a second contact subassembly 148 within a cavity 156 of the housing assembly 146. The second contact subassembly 148 includes at least one electrical conductor electrically and mechanically terminated to an electrical cable 150, which may be a coaxial cable. The cable 150 protrudes from the housing assembly 146 beyond the cable end 154. The housing assembly 146 includes a nose 158 that extends to the mating end 152. The nose 158 is cylindrically-shaped and hollow, defining the cavity 156 therethrough. The nose 158 surrounds a mating section of the second contact subassembly 148. The mating section of the second contact subassembly 148 is spaced apart radially from an inner surface 162 of the nose 158, such that an annular gap 163 is defined between the mating section and the inner surface 162.

In an embodiment, the housing assembly 146 of the plug connector 104 includes an outer housing 164 and an inner housing 166 that are coupled together. The outer housing 164 has the nose 158. The inner housing 166 extends from a rear end 168 of the outer housing 164 to the cable end 154, similar to the inner housing 130 of the receptacle connector 102. In the illustrated embodiment, the inner housing 166 includes two locking tabs 170 along an outer surface 172 thereof (although only one locking tab 170 is visible in FIG. 1). The outer housing 164 includes two stirrup-shaped latching members 174 extending rearward from the rear end 168. The latching members 174 are configured to latch or catch onto the corresponding locking tabs 170 to secure the inner housing 130 to the outer housing 164. In an alternative embodiment, the inner housing 166 may include one locking tab 170 or more than two locking tabs 170, and the outer housing 164 has a complementary number of latching members 174. The plug connector 104 also includes a wire seal cover 176 that is similar to the wire seal cover 136 of the receptacle connector 102. For example, the wire seal cover 176 covers the cable end 154 of the inner housing 166 and extends around the cable 150 to block the passage of debris and contaminants into the inner housing 166 through the cable end 154.

The plug connector 104 is mated to the receptacle connector 102 by moving one or both connectors 102, 104 generally along a mating trajectory 160 such that the nose 158 of the plug connector 104 is received through the mating opening 108 into the cavity 112 of the receptacle connector 102. The mating sections of the first and second contact subassemblies 114, 148 engage one another within the cavity 112 to form the conductive signal path. More specifically, the first and second contact subassemblies 114, 148 make contact within the sleeve 120 of the receptacle connector 102. The nose 158 is received in the annular gap 124 radially outside of the sleeve 120 such that the nose 158 surrounds the sleeve 120. The interface seal 126 engages the inner surface 162 of the nose 158 to seal an interface between the sleeve 120 of the receptacle connector 102 and the nose 158 of the plug connector 104.

The interface seal 126 (and other connector seals described herein) protects the electrical conductors and other components within the connectors 102, 104 from external debris, contaminants, and/or elements (such as harsh temperatures, humidity, and the like). For example, the connectors 102, 104 may be used in various industrial applications, such as automotive and military applications, that may expose the connectors 102, 104 to debris, contaminants, and/or harsh elements. The embodiments described herein provide sealing for the connectors 102, 104 to prevent such debris, contaminants, and/or elements from interfering with and/or damaging the conductive signal path across the connectors 102, 104.

In the illustrated embodiment, the receptacle connector 102 and the plug connector 104 are designed in accordance with certain industry standards. For example, the connectors 102, 104 may constitute FAKRA connectors. FAKRA is an abbreviation for the German term Fachnormenausschuss Kraftfahrzeugindustrie, and is the Automotive Standards Committee in the German Institute for Standardization, representing international standardization interests in the automotive field. FAKRA connectors are RF connectors that have a mating interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at specific impedances, such as 50, 75, 93, and/or 125 Ohms.

In the illustrated embodiment, the receptacle connector 102 has two key slots 180 that are formed in the outer housing 128. The key slots 180 extend radially outward from a perimeter of the mating opening 108. The key slots 180 are open to the cavity 112 and extend rearward. The plug connector 104 has two elongated key members 182 that extend radially outward from the nose 158 at spaced apart positions along the circumference of the nose 158. The key members 182 and key slots 180 may be part of a standardized design of the FAKRA connector standard. The key members 182 correspond with the key slots 180, such that the key members 182 are received within the corresponding key slots 180 as the nose 158 is received through the mating opening 108 to permit the connectors 102, 104 to mate. The key members 182 and key slots 180 are configured to permit mating in only one orientation of the plug connector 104 relative to the receptacle connector 102. If the plug connector 104 is misaligned (rotationally) relative to an orientation of the receptacle connector 102, the key members 182 abut against the outer housing 128 at the front end 110, preventing the plug connector 104 from being received within the cavity 112. The number, size, and positioning of the key members 182 and key slots 180 may be different in other embodiments. In an alternative embodiment, the connector system 100 may utilize other types of connectors other than FAKRA connectors.

Figure 2:
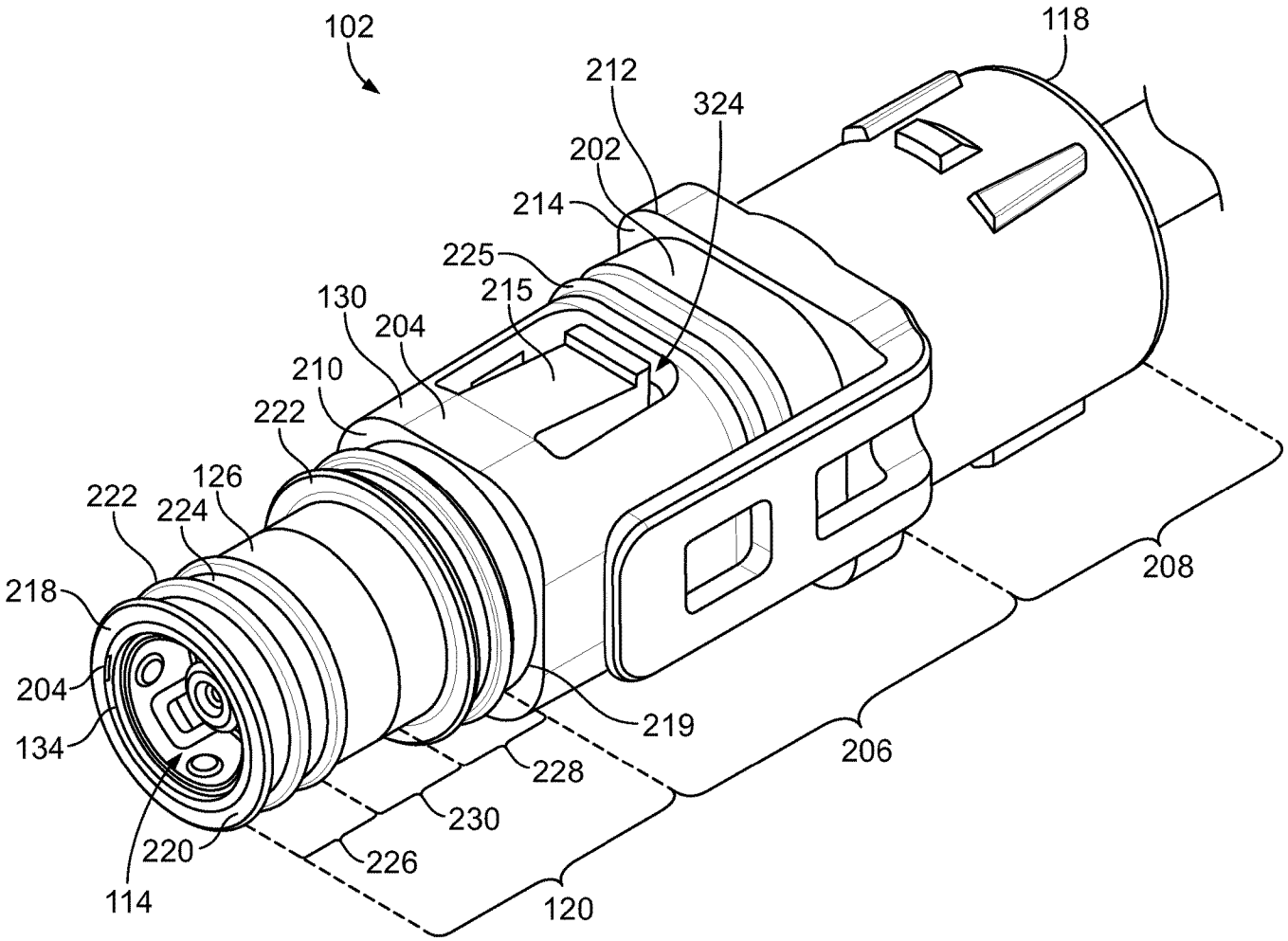
FIG. 2 is a perspective view of a receptacle connector of the connector system according to an embodiment shown without an outer housing.

FIG. 2 is a perspective view of the receptacle connector 102 according to an embodiment shown without the outer housing 128. The receptacle connector 102 in the illustrated embodiment includes the interface seal 126 and a rear housing seal 202. Both seals 126, 202 are disposed on an outer surface 204 of the inner housing 130, and extend around a perimeter of the inner housing 130. The inner housing 130 includes the sleeve 120, a base portion 206, and a cable portion 208. The sleeve 120 extends from a shoulder 210 to the mating end 134 of the inner housing 130. The shoulder 210 defines a transition between the sleeve 120 and the base portion 206. The interface seal 126 extends axially between a front end 218 and a back end 219. In an embodiment, the front end 218 of the interface seal 126 aligns with a distal end of the sleeve 120 at the mating end 134. For example, the front end 218 is coplanar with the distal end of the sleeve 120. In an alternative embodiment, the front end 218 may be located rearward of the distal end of the sleeve 120. In the illustrated embodiment, the back end 219 of the interface seal 126 engages the shoulder 210. Thus, in an embodiment the interface seal 126 surrounds a full axial length of the sleeve 120 from the shoulder 210 to the mating end 134.

The base portion 206 extends rearward to a flange 212. The latch arm 140 extends from the flange 212 and is spaced apart radially (or laterally) from the outer surface 204 of the base portion 206. The rear housing seal 202 is located on base portion 206 in front of the flange 212. The rear housing seal 202 may engage a front surface 214 of the flange 212. The inner housing 130 further includes a cantilevered deflectable latch 215 disposed axially between the interface seal 126 and the rear housing seal 202. The deflectable latch 215 in a resting position extends inward at least partially into a channel 216 (shown in FIG. 3) of the inner housing 130 to engage and secure the first contact subassembly 114 to the inner housing 130, as described in more detail with reference to FIG. 3. The cable portion 208 extends rearward from the flange 212 to the cable end 118 of the inner housing 130.

In an embodiment, the inner housing 130 is a dielectric composed of one or more thermoplastic materials. For example, the inner housing 130 may be a thermoplastic polyester material, such as one or more of polyethylene terephthalate (PET), polybutylene terephthalate (PBT), polyethylene terephthalate glycol-modified (PETG), and polycyclohexylenedimethylene terephthalate (PCT). The inner housing 130 can be formed via a molding process. The interface seal 126 and the rear housing seal 202 are each composed of a compressible polymer material, which may or may not be the same material for both seals 126, 202. For example, the interface seal 126 and/or the rear housing seal 202 may be composed of a silicone rubber material, along or with additional materials. The seals 126, 202 are compressible to conform to a contour of an interface in order to seal the respective interface. In an embodiment, the interface seal 126 is bonded to the outer surface 204 of the sleeve 120, which prevents the interface seal 126 from slipping, rotating, peeling back onto itself, or otherwise moving relative to the sleeve 120 during mating and operation of the connector system 100 (shown in FIG. 1).

The interface seal 126 has a molded body 220. Although the interface seal 126 could be pre-molded separately from the sleeve 120, in the preferred embodiment shown, the molded body 220 of the interface seal 126 is formed in-situ on the sleeve 120 of the inner housing 130. Thus, the interface seal 126 is not pre-molded or pre-formed and then loaded onto the sleeve 120. For example, the material of the interface seal 126 may be heated to a liquid phase and subsequently flowed (e.g., injected) into a mold that contains the inner housing 130 therein. The mold directs the heated material into engagement with the outer surface 204 of the sleeve 120. As the heated material cools, the heated material forms the molded body 220 of the interface seal 126. For example, the interface seal 126 and the inner housing 130 may be formed via a two-shot molding process that first molds the inner housing 130 (during a first shot) and thereafter overmolds the interface seal 126 on the inner housing 130 (during a second shot). Since the interface seal 126 is molded in-situ on the sleeve 120, the molded body 220 follows contours of the outer surface 204 of the sleeve 120. An interior surface of the interface seal 126 is defined by a profile of the outer surface 204 of the sleeve 120, such that if the outer surface 204 includes imperfections such as depressions, the interior surface of the interface seal 126 will have protrusions that complement the depressions.

In an embodiment, by forming the interface seal 126 in-situ on the sleeve 120 instead of pre-forming the seal 126 and attempting to load the pre-formed seal 126 around the sleeve 120, there is no risk of tearing the seal 126 or incorrectly positioning the seal 126 on the sleeve 120. The molded body 220 of the seal 126 may be relatively thin, such that the seal 126 could tear when handling and installing the seal 126 on the sleeve 120. For example, the molded body 220 of the interface seal 126 may have a radial thickness that is between about 0.2 mm and about 2.0 mm, such as between about 0.4 mm and about 1.0 mm.

The resulting molded body 220 is bonded to the outer surface 204. For example, the materials of the interface seal 126 and the inner housing 130 may be selected to permit bonding of the interface seal 126 to the sleeve 120 during the molding process. In one embodiment, the inner housing 130 is composed of PBT, and the interface seal 126 is silicone rubber which bonds to PBT. Bonding the seal 126 to the sleeve 120 prevents the seal 126 from peeling back, slipping, and otherwise moving out of position as the plug connector 104 (shown in FIG. 1) is mated to the receptacle connector 102.

In an embodiment, the rear housing seal 202 is formed in-situ on the base portion 206 of the inner housing 130 during the same molding process that forms the interface seal 126. The rear housing seal 202 bonds to the outer surface 204 of the inner housing 130 similarly to the interface seal 126. Forming the rear housing seal 202 in-situ avoids the task of attempting to slide the rear housing seal 202 around the inner housing 130 for a distance that extends from the mating end 134 to the flange 212. In an alternative embodiment, however, the interface seal 126 and/or rear housing seal 202 may be pre-formed and then loaded onto the inner housing 130 instead of formed in-situ on the inner housing 130.

As shown in FIG. 2, the interface seal 126 includes annular ribs 222 that extend outward along an outer surface 224 of the interface seal 126. Each annular rib 222 extends around a perimeter of the interface seal 126. The annular ribs 222 may enhance sealing or at least reduce the possibility of leak path formation by increasing an amount that the interface seal 126 compresses in engagement with the plug connector 104 (shown in FIG. 1) or another component. In the illustrated embodiment, the interface seal 126 includes multiple annular ribs 222 located along a front segment 226 of the interface seal 126 proximate to the mating end 134, and multiple annular ribs 222 located along a rear segment 228 of the seal 126 proximate to the flange 212. The seal 126 lacks annular ribs along a middle segment 230 that extends between the front and rear segments 226, 228. The rear housing seal 202 also includes annular ribs 225 similar to the annular ribs 222 of the interface seal 126.

Figure 3:
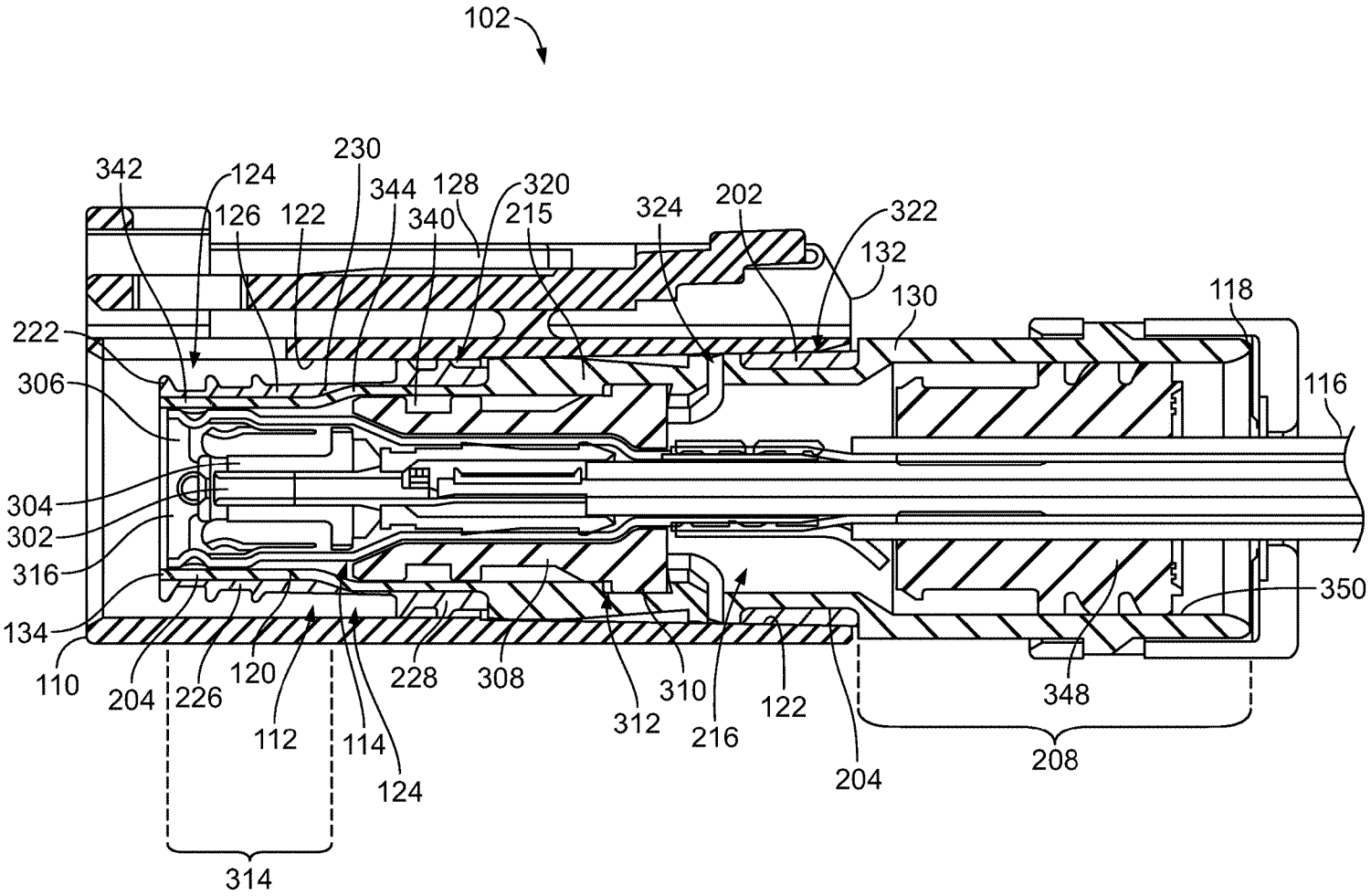
FIG. 3 is a side cross-sectional view of the receptacle connector according to an embodiment.

FIG. 3 is a side cross-sectional view of the receptacle connector 102 according to an embodiment. The outer housing 128 defines the cavity 112, which extends through the outer housing 128 between the front end 110 and the rear end 132. The inner housing 130 is held within the cavity 112. The inner housing 130 defines the channel 216, which extends through the inner housing 130 between the mating end 134 and the cable end 118. The first contact subassembly 114 and a portion of the cable 116 are disposed within the channel 216.

The first contact subassembly 114 includes a center contact 302, a dielectric body 304, and an outer contact 306. The dielectric body 304 surrounds the center contact 302. The outer contact 306 surrounds the dielectric body 304, such that the dielectric body 304 is disposed radially between the outer contact 306 and the center contact 302. The center contact 302 and the outer contact 306 are electrical conductors that are electrically terminated to corresponding electrical elements of the cable 116. For example, the center contact 302 and/or the outer contact 306 may be crimped, soldered, or otherwise electrically and mechanically connected to the corresponding electrical elements of the cable 116. The dielectric body 304 separates the center contact 302 from engaging the outer contact 306 to electrically insulate the center contact 302 from the outer contact 306. The contact subassembly 114 further includes a cavity insert 308 that engages and surrounds a portion of the outer contact 306. The cavity insert 308 has a flange 310 that is received within a receiving slot 312 of the deflectable latch 215 of the inner housing 130 to secure the contact subassembly 114 in a fixed position within the channel 216. When the contact subassembly 114 is fixed in place within the channel 216 via the deflectable latch 215, a mating section 314 of the contact subassembly 114 aligns with the sleeve 120 of the inner housing 130. The mating section 314 is an area located between the cavity insert 308 and a distal end 316 of the contact subassembly 114. The center contact 302, dielectric body 304, and outer contact 306 are the components of the contact subassembly 114 within the mating section 314. The mating section 314 is surrounded by the sleeve 120.

Figure 5:
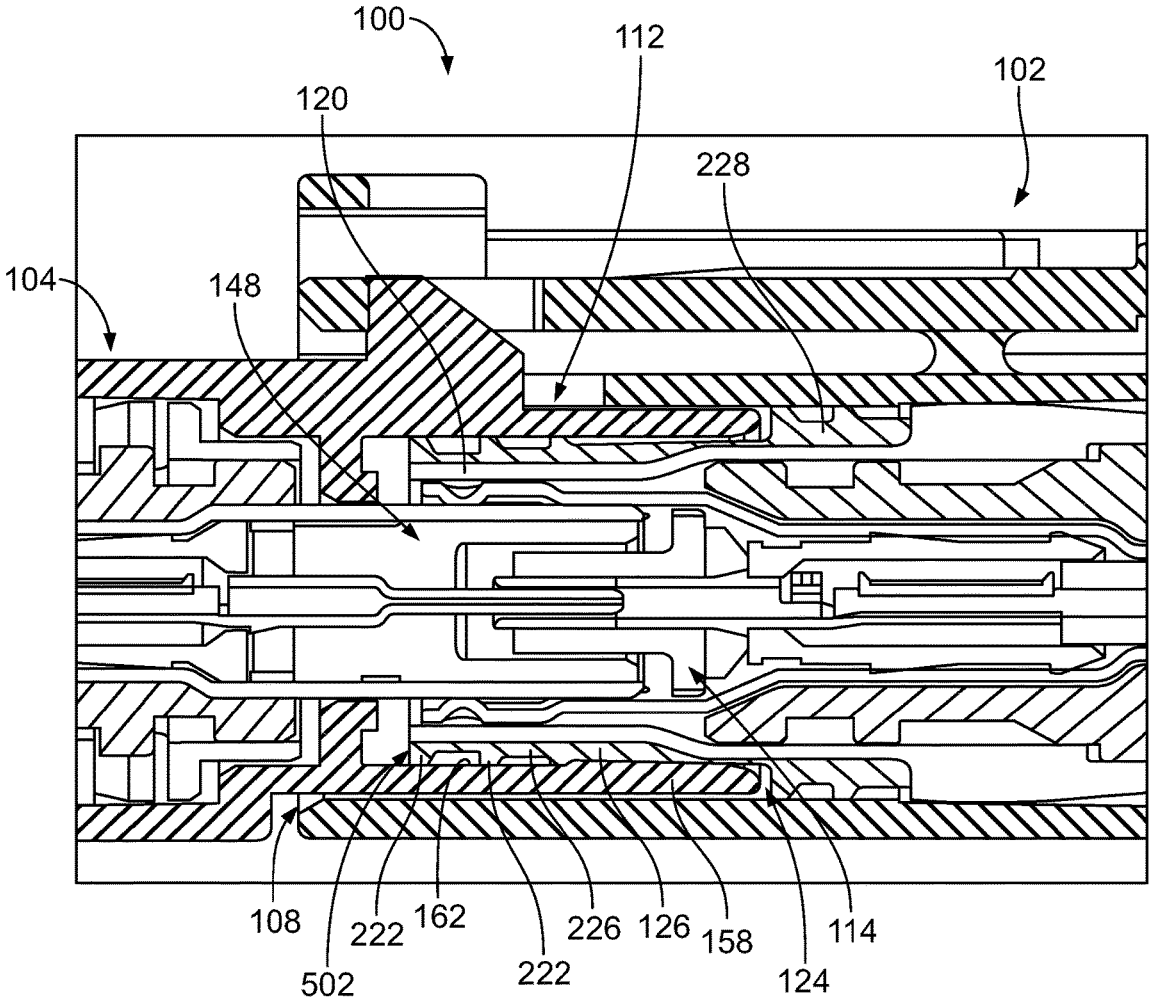
FIG. 5 is a cross-sectional view of a portion of the connector system showing the plug connector mated to the receptacle connector according to an embodiment.

As shown in FIG. 3, the interface seal 126 is disposed within the annular gap 124 that extends between the outer surface 204 of the sleeve 120 and the interior surface 122 of the outer housing 128. The annular ribs 222 of the interface seal 126 extend radially outward from the outer surface 204 toward the interior surface 122. In the illustrated embodiment, the interface seal 126 is configured to engage (and seal to) both the interior surface 122 of the outer housing 128 and the nose 158 (shown in FIG. 1) of the plug connector 104 (FIG. 1). For example, the front segment 226 of the interface seal 126 is configured to engage the inner surface 162 of the nose 158, as shown in FIG. 5, and the rear segment 228 of the interface seal 126 engages the interior surface 122 of the outer housing 128. Thus, the annular ribs 222 at the rear segment 228 extend across the annular gap 124 and engage the interior surface 122 to seal a front housing interface 320 between the outer housing 128 and the inner housing 130. Similarly, the rear housing seal 202 extends outward from the inner housing 130 and engages the interior surface 122 to seal a rear housing interface 322 between the outer and inner housings 128, 130. The rear housing interface 322 is located at or proximate to the rear end 132 of the outer housing 128. As shown in FIG. 2, the area of the inner housing 130 around the deflectable latch 215 includes an opening 324, which could potentially allow debris and contaminants into the channel 216. By sealing the front housing interface 320 and the rear housing interface 322, debris and contaminants are blocked from accessing the opening 324. In an embodiment, the only openings in the outer housing 128 are located at the front end 110 and the rear end 132. Therefore, the only potential paths for debris and contaminants to access the opening 324 are sealed at the front housing interface 320 and the rear housing interface 322.

In an embodiment, the sleeve 120 of the inner housing 130 tapers from a wide diameter section 340 to a narrow diameter section 342. The narrow diameter section 342 extends to the mating end 134. The front segment 226 of the interface seal 126 is disposed on the narrow diameter section 342. The rear segment 228 of the interface seal 126, which seals to the outer housing 128, is disposed on the wide diameter section 340. In an embodiment, the middle segment 230 of the interface seal 126 is disposed on a transition area 344 of the sleeve 120, which has a stepped or S-curve cross-sectional shape.

In an alternative embodiment, the interface seal does not include the middle segment 230 and the rear segment 228. Rather, the interface seal is the front segment 226 shown in FIG. 3. The receptacle connector 102 includes a front housing seal that is separate from the interface seal. The front housing seal is the rear segment 228 shown in FIG. 3, such that the front housing seal engages the interior surface 122 of the outer housing 128. The front housing seal is spaced apart axially from the interface seal. Therefore, at least a portion of the transition area 344 of the sleeve 120 is exposed and not covered by a seal. When the nose 158 (shown in FIG. 1) of the plug connector 104 is received in the cavity 112, the front housing seal does not engage the nose 158. In this alternative embodiment, the receptacle connector 102 includes two discrete seals that replace the unitary interface seal 126 shown in FIGS. 2 and 3. In this alternative embodiment, the two seals may be formed in-situ on the sleeve 120 which bonds the seals to the sleeve 120, as described above with respect to the unitary interface seal 126.

The receptacle connector 102 further includes a wire seal 348 within the channel 216 along the cable portion 208 of the inner housing 130. The wire seal 348 provides sealing between the cable 116 and an inner surface 350 of the inner housing 130 at the cable end 118. The wire seal 348 is composed of a compressible material, such as a rubberized polymer.

Figure 4:
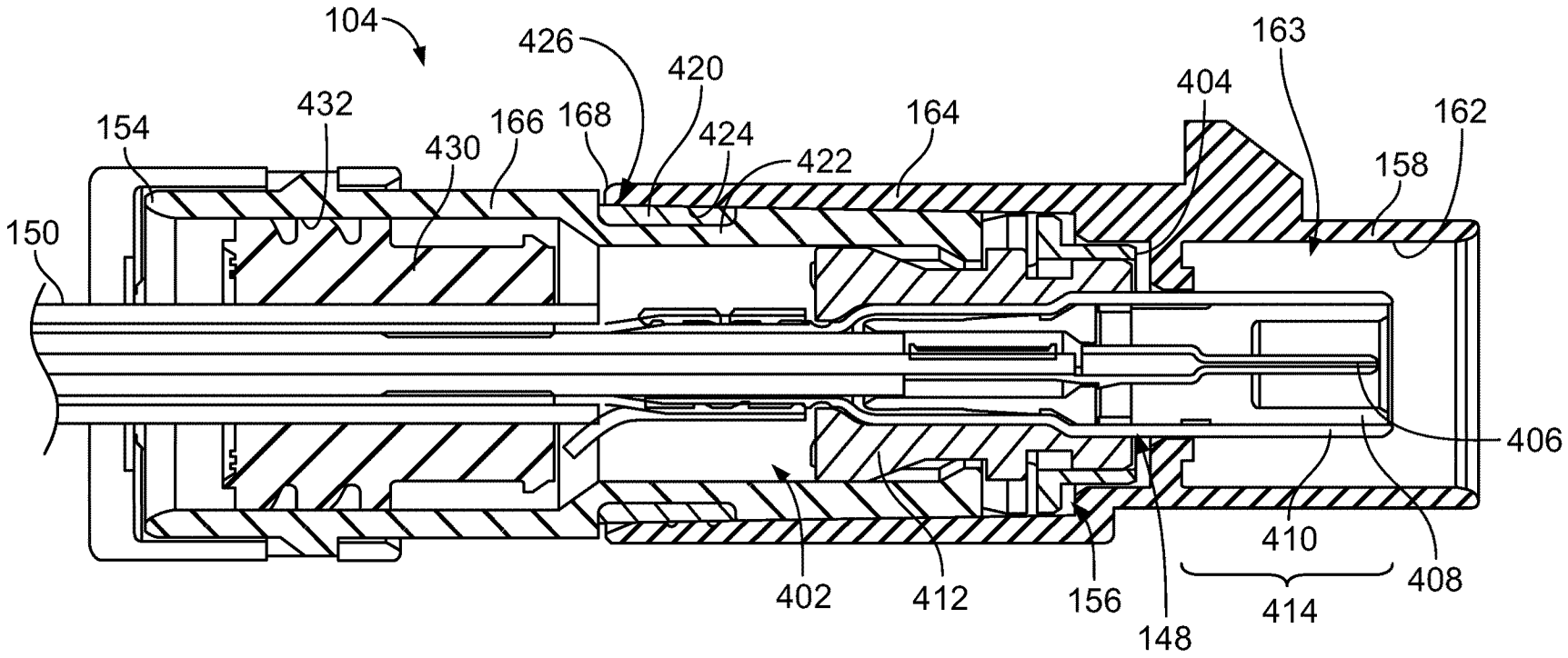
FIG. 4 is a side cross-sectional view of a plug connector of the connector system according to an embodiment.

FIG. 4 is a side cross-sectional view of the plug connector 104 according to an embodiment. The inner housing 166 of the plug connector 104 is held within the cavity 156 of the outer housing 164. The inner housing 166 defines a channel 402 therethrough between the cable end 154 and an opposite front end 404 of the inner housing 166. The second contact subassembly 148 is held in the channel 402. The second contact subassembly 148 is similar to the first contact subassembly 114 (shown in FIG. 3) of the receptacle connector 102. For example, the second contact subassembly 148 includes a center contact 406, an outer contact 410, and a dielectric body 408 disposed between the center contact 406 and the outer contact 410. A cavity insert 412 of the contact subassembly 148 surrounds and engages the outer contact 410. The cavity insert 412 latches to the inner housing 166 to secure the contact subassembly 148 in place within the channel 402. In the illustrated embodiment, a mating section 414 of the second contact subassembly 148 extends beyond the front end 404 of the inner housing 166. The mating section 414 is comprised of portions of the center contact 406, the outer contact 410, and the dielectric body 408. The mating section 414 is surrounded by the nose 158 of the outer housing 164. The mating section 414 is spaced apart radially from the inner surface 162 of the nose 158 by the annular gap 163.

The plug connector 104 includes a rear housing seal 420 disposed on an outer surface 422 of the inner housing 166. The rear housing seal 420 is located at or proximate to the rear end 168 of the outer housing 164. The rear housing seal 420 extends outward from the inner housing 166 and engages an interior surface 424 of the outer housing 164 to seal a rear housing interface 426 between the outer and inner housings 164, 166. The rear housing seal 420 may be similar to the rear housing seal 202 (shown in FIG. 2) of the receptacle connector 102. For example, the rear housing seal 420 may be composed of the same or a similar compressible material as the rear housing seal 202. The rear housing seal 420 may be pre-formed and then installed on the inner housing 166 or alternatively formed in-situ on the outer surface 422 of the inner housing 166 (such as via a two-shot overmold process as described in FIG. 2 with reference to the rear housing seal 202).

The plug connector 104 also includes a wire seal 430 within the channel 402 rearward of the contact subassembly 148. The wire seal 430 is similar to, or the same as, the wire seal 348 (shown in FIG. 3) of the receptacle connector 102. For example, the wire seal 348 provides sealing between the cable 150 and an inner surface 432 of the inner housing 166.

FIG. 5 is a cross-sectional view of a portion of the connector system 100 showing the plug connector 104 mated to the receptacle connector 102 according to an embodiment. During a mating operation, the plug connector 104 is received within the cavity 112 of the receptacle connector 102 through the mating opening 108. The second contact subassembly 148 (e.g., the mating section 414 thereof shown in FIG. 4) is received within the sleeve 120 and engages the first contact subassembly 114 (e.g., the mating section 314 thereof shown in FIG. 3) to form the conductive signal path between the connectors 102, 104. The nose 158 of the plug connector 104 is received within the annular gap 124 outside of the sleeve 120. The interface seal 126 on the sleeve 120 engages the inner surface 162 of the nose 158. For example, the annular ribs 222 along the front segment 226 of the seal 126 engage the inner surface 162. In the illustrated embodiment, the rear segment 228 of the interface seal 126 is spaced apart axially from and does not engage the nose 158, however the nose 158 may abut against the rear segment 228 in an alternative embodiment. The interface seal 126 seals a separable interface 502 between the sleeve 120 and the nose 158. When the plug connector 104 is mated to the receptacle connector 102, the interface seal 126 prevents debris and contaminants from entering the sleeve 120 and interfering with the contact subassemblies 114, 148, which may result in better performance of the connector system 100 and/or a longer operating life of the connector system 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector comprising:

an outer housing defining a cavity through the outer housing between a front end and an opposite rear end of the outer housing, the outer housing configured to receive a plug connector into the cavity through a mating opening at the front end;

an inner housing disposed within the cavity of the outer housing, the inner housing defining a channel through the inner housing between a mating end and an opposite cable end of the inner housing, the inner housing holding a contact subassembly within the channel, the contact subassembly electrically and mechanically connected to a cable protruding from the cable end of the inner housing, the inner housing including a sleeve extending to the mating end, the sleeve surrounding a mating section of the contact subassembly, the sleeve spaced apart from an interior surface of the outer housing by an annular gap, a diameter of the sleeve tapering from a wide diameter section to a narrow diameter section that extends to a distal end of the sleeve; and an interface seal on an outer surface of the sleeve of the inner housing, the interface seal extending axially between a front segment and a rear segment, wherein the front segment is disposed on the narrow diameter section of the sleeve and is configured to engage an inner surface of a nose of the plug connector within the annular gap to seal an interface between the sleeve of the inner housing and the nose of the plug connector, and wherein the rear segment is disposed on the wide diameter section of the sleeve and extends across the annular gap to engage the interior surface of the outer housing to seal an interface between the inner housing and the outer housing.

2. The receptacle connector of claim 1, wherein the interface seal includes annular ribs extending from an outer side of the interface seal, the annular ribs engaging the inner surface of the nose of the plug connector.

3. The receptacle connector of claim 1, wherein a front end of the interface seal aligns with the distal end of the sleeve.

4. The receptacle connector of claim 1, wherein the interface seal is bonded to the outer surface of the sleeve.

5. The receptacle connector of claim 1, wherein the interface seal has a molded body that is formed in-situ on the sleeve.

6. The receptacle connector of claim 1, wherein the interface seal is composed of a silicone rubber material and the sleeve of the inner housing is composed of a thermoplastic polyester material.

7. The receptacle connector of claim 1, wherein the inner housing protrudes beyond the rear end of the outer housing, the inner housing including a latch arm that extends around the rear end of the outer housing, the latch arm coupling to a locking tab on an exterior surface of the outer housing to secure the inner housing to the outer housing.

8. The receptacle connector of claim 1, further comprising a rear housing seal bonded to the outer surface of the inner housing rearward of the interface seal, the rear housing seal engaging the interior surface of the outer housing at least proximate to the rear end of the outer housing to seal an interface between the inner housing and the outer housing.

9. The receptacle connector of claim 1, wherein the contact subassembly includes a center contact and an outer contact that surrounds the center contact, the contact subassembly further including a dielectric body disposed between the center contact and the outer contact.

10. A connector system comprising:

a receptacle connector including a housing assembly, a first contact subassembly, and an interface seal, the housing assembly including an outer housing and an inner housing, the outer housing defining a cavity through the outer housing between a front end and an opposite rear end of the outer housing the inner housing including a sleeve disposed within the cavity, the sleeve surrounding a mating section of the first contact subassembly, the sleeve tapering from a wide diameter section to a narrow diameter section, the housing assembly defining an annular gap between an outer surface of the sleeve and an interior surface of the housing assembly that defines the cavity, the interface seal bonded to the outer surface of the sleeve and extending circumferentially around the sleeve, the interface seal including a front segment disposed on the narrow diameter section of the sleeve and a rear segment disposed on the wide diameter section; and a plug connector including a housing and a second contact subassembly, the housing including a nose at a mating end thereof that surrounds a mating section of the second contact subassembly, wherein the plug connector is configured to be received within the cavity of the housing assembly such that the nose is received within the annular gap radially outside of the sleeve, the mating section of the second contact subassembly engaging the mating section of the first contact subassembly within the sleeve, the front segment of the interface seal engaging an inner surface of the nose to seal an interface between the sleeve of the receptacle connector and the nose of the plug connector, wherein the rear segment of the interface seal extends across the annular gap rearward of the nose and engages the interior surface of the outer housing to seal an interface between the inner housing and the outer housing.

11. The connector system of claim 10, wherein the interface seal includes annular ribs extending from an outer side of the interface seal, the annular ribs engaging the inner surface of the nose of the plug connector.

12. The connector system of claim 10, wherein the interface seal has a molded body that is formed in-situ on the sleeve.

13. The connector system of claim 10, wherein the front end of the outer housing of the receptacle connector defines a key slot that is open to the cavity, the nose of the housing of the plug connector including a key member extending outward from the nose that is received within the key slot to orient the plug connector relative to the receptacle connector.

14. A receptacle connector comprising:

an outer housing defining a cavity through the outer housing between a front end and an opposite rear end of the outer housing, the outer housing defining a mating opening to the cavity at the front end and a key slot extending radially outward from the mating opening, the mating opening configured to receive a nose of a plug connector therethrough and the key slot configured to receive a key member therethrough, the key member extending outward from the nose of the plug connector to orient the plug connector relative to the housing, the outer housing including a locking tab on an exterior surface thereof;

an inner housing disposed within the cavity of the outer housing and protruding beyond the rear end of the outer housing, the inner housing defining a channel through the inner housing between a mating end and an opposite cable end of the inner housing, the inner housing holding a contact subassembly within the channel, the contact subassembly electrically and mechanically connected to a cable protruding from the cable end of the inner housing, the inner housing including a latch arm that extends around the rear end of the outer housing and couples to the locking tab of the outer housing to secure the inner housing to the outer housing, the inner housing including a sleeve extending to the mating end, the sleeve surrounding a mating section of the contact subassembly, the sleeve spaced apart from an interior surface of the outer housing by an annular gap; and an interface seal on an outer surface of the sleeve of the inner housing, the interface seal configured to engage an inner surface of a nose of the plug connector within the annular gap to seal an interface between the sleeve of the inner housing and the nose of the plug connector.

15. The receptacle connector of claim 14, wherein the interface seal has a molded body that is formed in-situ on the sleeve and is bonded to the outer surface of the sleeve.

16. The receptacle connector of claim 14, wherein the interface seal extends axially between a front end and a back end, a front segment of the interface seal at the front end engaging the nose of the plug connector, a rear segment of the interface seal at the back end extending across the annular gap and engaging the interior surface of the outer housing to seal an interface between the inner housing and the outer housing.

17. The receptacle connector of claim 16, wherein a diameter of the sleeve of the inner housing tapers from a wide diameter section to a narrow diameter section that extends to a distal end of the sleeve, wherein the front segment of the interface seal is disposed on the narrow diameter section, and the rear segment of the interface seal is disposed on the wide diameter section.

18. The connector system of claim 10, wherein the inner housing of the receptacle connector protrudes beyond the rear end of the outer housing of the receptacle connector, the inner housing including a latch arm that extends around the rear end of the outer housing and is coupled to a locking tab on an exterior surface of the outer housing to secure the inner housing to the outer housing.

* * * * *